US009199770B2

(12) United States Patent
Rose

(10) Patent No.: US 9,199,770 B2
(45) Date of Patent: Dec. 1, 2015

(54) PORTABLE FUEL CONTAINER SYSTEM WITH ATTACHMENT MEANS AND ASSOCIATED METHODS

(71) Applicant: Steven Rose, Melbourne, FL (US)

(72) Inventor: Steven Rose, Melbourne, FL (US)

( * ) Notice: Subject to any disclaimer, the term of this patent is extended or adjusted under 35 U.S.C. 154(b) by 2 days.

(21) Appl. No.: 14/302,457

(22) Filed: Jun. 12, 2014

(65) Prior Publication Data

US 2014/0291359 A1 Oct. 2, 2014

Related U.S. Application Data

(63) Continuation-in-part of application No. 13/906,534, filed on May 31, 2013, now abandoned.

(60) Provisional application No. 61/660,462, filed on Jun. 15, 2012.

(51) Int. Cl.

| | |
|---|---|
| ***B67D 3/00*** | (2006.01) |
| ***B65D 47/24*** | (2006.01) |
| ***B67D 7/00*** | (2010.01) |
| ***B67D 7/04*** | (2010.01) |
| ***B65D 1/02*** | (2006.01) |
| ***B65D 50/06*** | (2006.01) |

(52) U.S. Cl.

CPC ..... *B65D 47/243* (2013.01); *B65D 1/0223* (2013.01); *B65D 50/06* (2013.01); *B67D 7/005* (2013.01); *B67D 7/04* (2013.01)

(58) Field of Classification Search

CPC ..... B67D 7/005; B67D 3/02; B67D 3/043; B65D 23/48; B65D 47/243

USPC ..... 222/175, 522–525, 511, 513–514; 224/148.1–148.7; 141/285, 351, 352, 141/291, 292

See application file for complete search history.

(56) References Cited

U.S. PATENT DOCUMENTS

| | | | | |
|---|---|---|---|---|
| 529,221 | A | 11/1894 | Wagner | |
| 692,089 | A * | 1/1902 | Swisher | 224/148.7 |
| 1,208,728 | A * | 12/1916 | Bartlett | 224/148.6 |
| 2,437,589 | A * | 3/1948 | Bink | 222/493 |
| 3,074,444 | A | 1/1963 | Hawksford | |
| 3,278,094 | A * | 10/1966 | Perry | 222/479 |
| 3,606,096 | A * | 9/1971 | Campbell | 222/479 |

(Continued)

OTHER PUBLICATIONS

Richard G. Budynas and J. Keith Bisbett, Shigley's Mechanical Engineering Design, McGraw Hill, 8th Edition, p. 85.*

(Continued)

*Primary Examiner* — Paul R Durand
*Assistant Examiner* — Randall Gruby
(74) *Attorney, Agent, or Firm* — Mark Malek; Daniel Pierron; Widerman Malek, PL

(57) ABSTRACT

Provided is a portable container system for holding and dispensing a quantity of fuel. The container includes an attachment for attaching the container to a support area, such as a belt loop, and a self-closing dispensing cap for dispensing the gasoline contained within the container. Additionally, the container is constructed of an approved material for storing gasoline, is painted bright red, and includes a warning that indicates the contents of the container. The internal volume of the container holds between 16-32 ounces of fuel, which provides extended use of conventional lawn equipment while being light enough to attach to a belt loop or other support area for hands-free use.

14 Claims, 7 Drawing Sheets

(56) References Cited

U.S. PATENT DOCUMENTS

| | | | | | |
|---|---|---|---|---|---|
| 4,598,743 | A * | 7/1986 | Milling | 141/296 |
| 4,667,710 | A * | 5/1987 | Wu | 141/198 |
| 4,982,881 | A | 1/1991 | Amrein | |
| 5,076,333 | A * | 12/1991 | Law | 141/198 |
| 5,078,924 | A | 1/1992 | Spinello | |
| 5,207,657 | A * | 5/1993 | Gibilisco | 604/295 |
| 5,226,574 | A | 7/1993 | Durinzi | |
| 5,249,611 | A * | 10/1993 | Law | 141/198 |
| 5,419,378 | A * | 5/1995 | Law | 141/198 |
| 5,560,522 | A * | 10/1996 | Clark | 222/481.5 |
| 5,669,533 | A * | 9/1997 | Kelley et al. | 222/525 |
| 5,740,951 | A | 4/1998 | Jack | |
| 5,992,715 | A | 11/1999 | Habibi | |
| 6,039,207 | A | 3/2000 | Adamek | |
| 6,227,419 | B1 * | 5/2001 | Raboin | 222/484 |
| 6,457,616 | B2 | 10/2002 | Gagne | |
| 6,478,058 | B1 * | 11/2002 | Pears | 141/353 |
| D481,937 | S | 11/2003 | McRae | |
| 6,712,103 | B2 | 3/2004 | Komaba | |
| 6,726,069 | B2 * | 4/2004 | Machover | 224/148.7 |
| 6,871,680 | B2 * | 3/2005 | Trippi, Jr. | 141/350 |
| 6,889,732 | B2 * | 5/2005 | Allen | 141/353 |
| 7,013,936 | B2 * | 3/2006 | Schliemann et al. | 141/353 |
| D545,679 | S | 7/2007 | Kelleghan | |
| 7,802,704 | B2 | 9/2010 | Hatch | |
| 8,028,729 | B2 * | 10/2011 | Kaempf | 141/353 |
| 8,201,595 | B2 * | 6/2012 | Trippi, Jr. | 141/292 |
| 2001/0042764 | A1 * | 11/2001 | Baldwin | 222/513 |
| 2003/0150520 | A1 * | 8/2003 | Trippi, Jr. | 141/350 |
| 2004/0217139 | A1 | 11/2004 | Roth | |
| 2007/0077370 | A1 | 4/2007 | Ulcar | |
| 2008/0078787 | A1 * | 4/2008 | Yelland | 224/148.1 |
| 2010/0078094 | A1 * | 4/2010 | Trippi, Jr. | 141/350 |
| 2011/0247994 | A1 | 10/2011 | Siciliano | |
| 2014/0367409 | A1 * | 12/2014 | Digregorio et al. | 222/1 |

OTHER PUBLICATIONS

United States Patent and Trademark Office, Office Action dated Apr. 24, 2014, cited in counterpart U.S. Appl. No. 13/906,534, filed May 31, 2013 (9 pages).

* cited by examiner

PORTABLE FUEL CONTAINER SYSTEM WITH ATTACHMENT MEANS AND ASSOCIATED METHODS

CROSS REFERENCE TO RELATED APPLICATION

The present application is a continuation in part application of U.S. patent application Ser. No. 13/906,534 titled Portable Fuel Container with Attachment Means filed on May 31, 2013, which, in turn, claimed priority to U.S. Provisional Patent Application Ser. No. 61/660,462, filed on Jun. 15, 2012, titled Quick Fill, the entire contents of each of which are hereby incorporated into this application by reference to provide continuity of disclosure.

FIELD OF THE INVENTION

The present invention relates to a fuel container system. More specifically, it relates to a portable fuel container system with an attachment means for securing the device to a belt loop or other personal support area for hauling a readily dispensable quantity of reserve fuel during lawn maintenance and construction activities.

BACKGROUND OF THE INVENTION

A variety of lawn tools are known and available to assist individuals with maintaining their yard. In addition to conventional lawn tools such as hand rakes, shovels, and brooms, various types of powered lawn equipment are designed to increase the speed and efficiency of outdoor maintenance activities. Conventional powered lawn equipment such as lawnmowers, edgers, and trimmers help increase the speed and efficiency of yard maintenance. The majority of powered lawn equipment utilizes small, internal combustion engines that may be of two- or four-stroke design. As can be appreciated, an internal combustion engine is a power source whereby the combustion of a fuel occurs with air inside of a combustion chamber. Combustion of the fuel causes expansion of the ignited gases within the chamber, which applies force and work to an engine component such as a piston, turbine blade, or nozzle to drive the tool output.

The most common source of fuel for powered lawn equipment for internal combustion engines is gasoline, which is purchased at a gas station and stored in a fuel container. For many decades, fuel was commonly stored in a jerrycan, which is a container constructed from pressed steel. Modern fuel containers, however, are available in sizes ranging from one to five gallons or more and are often formed of a plastic material that contains the liquid fuel and vapors therein. Modern fuel containers are subject to both federal and state laws that require fuel containers to be painted bright red and plainly marked with the word "gasoline" or with the warning "flammable—keep fire away." This ensures the contents of the container are easily identified for safety and kept away from heat sources or open flames.

Current fuel containers are designed to be filled at a gas station and transported to the power equipment for filling. This is preferable to transporting the power equipment to the gas station for filling, as many individuals do not have the capability to transport large equipment such as ride-on lawnmowers to the fuel source itself. Because of this, conventional fuel containers hold a large volume of gasoline to limit the number of trips to a gasoline filling station. While this is beneficial for preventing multiple trips to the gas station, it generally requires a user to transport the equipment in need of fuel to the fuel container or lug the large container to an area where it can be easily accessed. This may be impractical for users with large properties or for landscapers who care for multiple properties in the same neighborhood that are away from their fuel source.

When powered equipment runs out of gasoline and requires refueling, the homeowner and landscaper must stop working and return to the fuel source with the equipment in need of fuel. This extends the amount of time it takes for a homeowner to complete a project, or for a landscaper to finish maintaining a customer's property. To limit the number of trips back to the fuel source, a common practice involves storing gasoline in a conventional water bottle. As can be appreciated, conventional water bottles do not meet the legal requirements for storing fuel and may be mistaken for a water bottle holding a consumable beverage.

The present invention overcomes the problems inherent in conventional gasoline containers with a device that reduces the number of trips back to a fuel source for refilling garden power tools and equipment. The device comprises a portable container for holding a quantity of fuel for use in an internal combustion engine and a self-closing cap for dispensing fluid from the container. The container meets current Environmental Protection Agency requirements for gas cans and is painted bright red in color with identifying indicia on the exterior of the container. The cap meets OSHA regulations and utilizes an automatic closure, wherein the cap automatically springs to the closed position when not pouring. The container additionally includes an attachment means for securing the container to a user's belt loop such that the user can walk with the quantity of fuel without being hampered or bothered during a work activity. The present invention provides a convenient way to carry a quantity of fuel that limits the number of trips back to a fuel source for refilling.

DESCRIPTION OF THE PRIOR ART

Devices have been disclosed in the prior art that relate to fuel containers. These include devices that have been patented and published in patent application publications, and generally relate to containers for holding a quantity of gasoline. The following is a list of devices deemed most relevant to the present disclosure, which are herein described for the purposes of highlighting and differentiating the unique aspects of the present invention, and further highlighting the drawbacks existing in the prior art.

Specifically, Durinzi, U.S. Pat. No. 5,226,574 discloses a portable gasoline container. The device is molded of plastic and includes a top fill opening, an upwardly-extending pouring spout, and handle regions molded into the container. The spout is slightly flexible and can be placed into the entrance end of a downwardly-extending inlet to an automobile gas tank. The container is then rotated about the axes of the spout so that the spout extends downwardly into the tank inlet and the body of the container is higher than the inlet. Once rotated, gasoline is dispensed through the spout into the gas tank. The Durinzi device is adapted for use with filling automobile gas tanks and does not disclose a container with an attachment means for securing to the belt loop of a user.

Hatch, U.S. Pat. No. 7,802,704 discloses a gasoline can having a nozzle assembly which includes a ball valve that is in an open mode when the can's nozzle is lifted for pouring and in a closed mode when the can's nozzle is in a lowered storage mode. The Hatch device describes a conventional fuel container with a novel nozzle assembly, but does not disclose an attachment means for securing the container to a user's belt.

Amrein, U.S. Pat. No. 4,982,881 discloses a nozzle for a fuel container that includes a first and second nozzle part. The first nozzle part comprises a flange for engaging a collar to secure it to a container, while a second nozzle part has an outlet opening that slidably engages the first nozzle part. A spring acts between the first and second nozzle parts to urge them apart. A valve member is secured to the second nozzle part and includes a closure member. This device discloses a nozzle for a conventional gas can, and does not disclose a portable fuel container.

Raboin, U.S. Pat. No. 6,435,380 discloses a spout for a container comprising a conduit having a first end connected to the container, an aperture, and a second end configured to be inserted into an opening. The second end of the conduit is configured to direct fluid out of the second end of the conduit. A closure plate extending across the diameter of the conduit prevents flow through the conduit. The closure plate has a closed position to inhibit flow through the conduit, and an open position to allow flow through the conduit. A sleeve movably responsive to inserting the conduit into the opening moves the closure plate from the closed position to the open position. Similar to the Amrein device, Raboin provides a spout with a spring-loaded closure means to prevent fuel vapors from escaping when the container is being stored.

Finally, Siciliano, U.S. Patent Application Publication No. 2011/0247994 discloses a securing member for a portable water bottle. The securing member comprises an elongated, flat member having a first end and a second end. The first end rotates about a first degree of freedom relative to the securing member so that the second end may move away from or towards the container surface. The first end also rotates about a second degree of freedom relative to the securing member so that the second end may move laterally relative to the container surface. While the Siciliano device provides a portable bottle with an attachment means, the bottle does not meet current Environmental Protection Agency requirements for gas cans, is not painted bright red in color, and does not include identifying indicia on the exterior of the container.

The devices disclosed in the prior art provide gas containers for holding a quantity of fuel for use with powered lawn equipment. These devices include a large internal volume to contain one or more gallons of fuel. As can be appreciated, a container of gasoline holding one or more gallons of fuel cannot be easily supported by a user on his or her waist. The present invention provides a fuel container designed to hold 16-32 ounces of fuel that includes an attachment means specifically designed to be supported on a user's belt loop. The size of the container and the attachment means allow a user to transport the present invention in a hands-free manner, thereby providing constant access to a source of fuel.

In light of the prior art and the disclosed elements of the present invention, it is submitted that the present invention substantially diverges in design elements from the prior art. Consequently, it is clear that the present invention is not described by the art and that a need exists for a fuel container with an attachment means that secures the device to a belt loop or support area. In this regard, the instant invention substantially fulfills these needs.

SUMMARY OF THE INVENTION

In view of the foregoing disadvantages inherent in the known types of fuel containers now present in the prior art, the present invention provides a new fuel container wherein the same can be utilized for providing convenience for the user when filling an internal combustion engine with gasoline.

It is therefore an object of the present invention to provide a new and improved fuel container that has all of the advantages of the prior art and none of the disadvantages.

It is another object of the present invention to provide a fuel container for holding a small quantity of gasoline that is securable on the user's person during work activities.

Another object of the present invention is to provide a fuel container with an attachment means that secures the device to a belt loop or support area.

Yet another object of the present invention is to provide a fuel container that meets current EPA and OSHA regulations for gasoline containers.

Another object of the present invention is to provide a fuel container with a self-closing dispensing cap that fits into the opening of a powered lawn equipment fuel tank.

A final object of the present invention is to provide a fuel container that may be readily fabricated from materials that permit relative economy and that are commensurate with durability.

Other objects, features and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and the manner in which it may be made and used may be better understood after a review of the following description, taken in connection with the accompanying drawings wherein like numeral annotations are provided throughout.

DETAILED DESCRIPTION OF THE INVENTION

Figure 1:
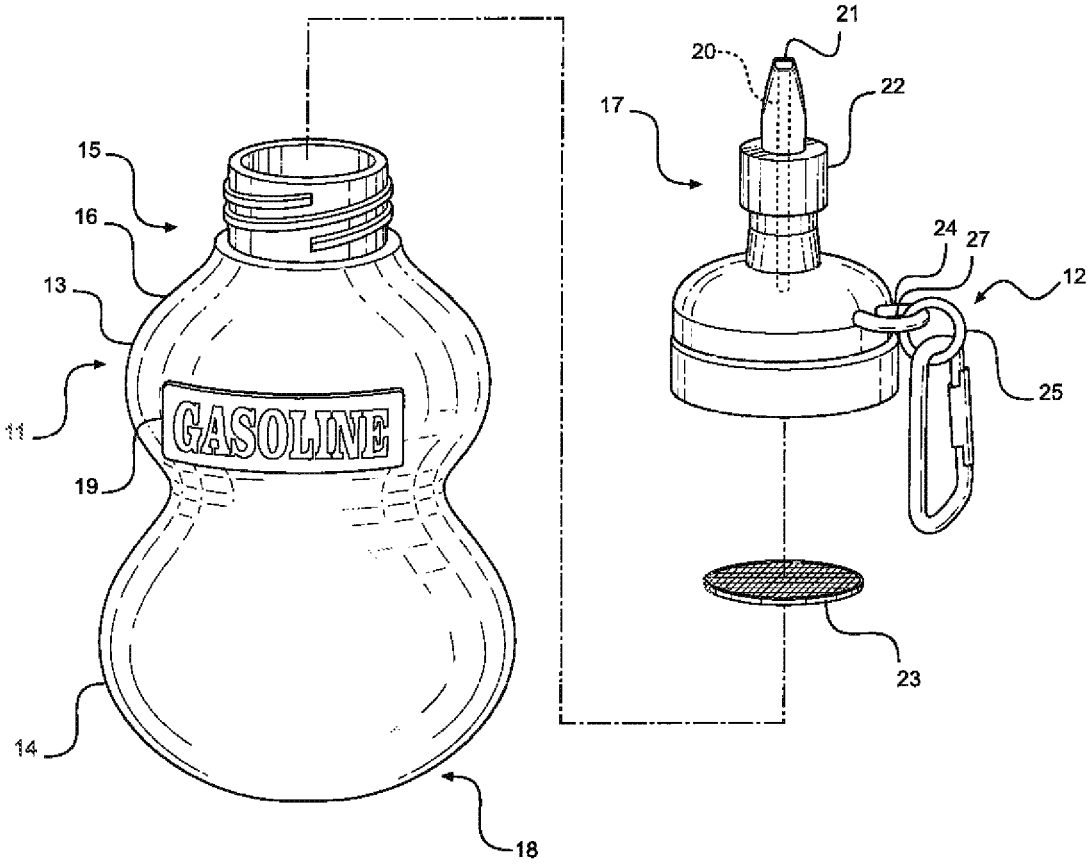
FIG. 1 shows an exploded view of the present invention highlighting its constituent elements.

Reference is made herein to the attached drawings. Like reference numerals are used throughout the drawings to depict like or similar elements of the container. For the purposes of presenting a brief and clear description of the present invention, the preferred embodiment will be discussed as used for storing and transporting a quantity of fuel for use in an internal combustion engine. The figures are intended for representative purposes only and should not be considered to be limiting in any respect.

Figure 9:
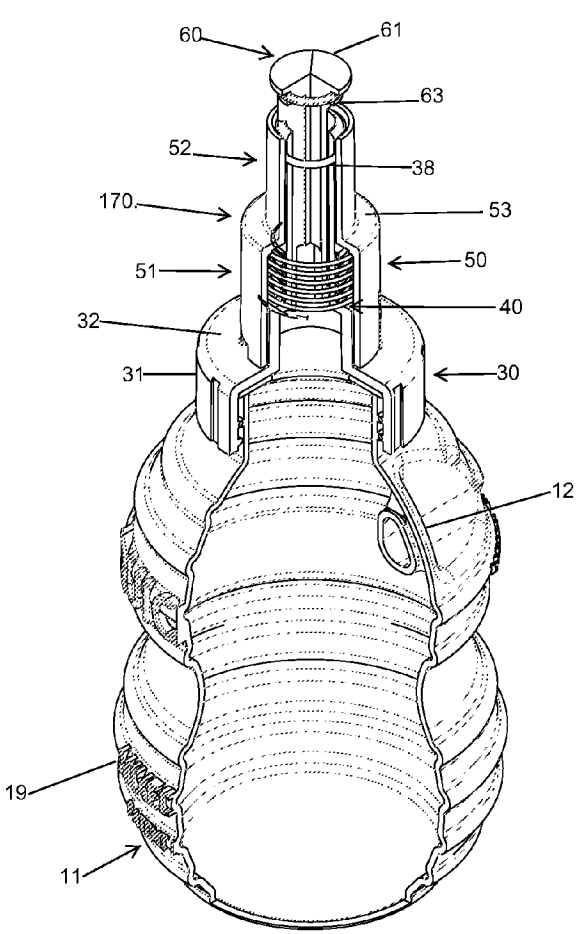
FIG. 9 shows a partial cut away view of the container system illustrated in FIG. 8.
Figure 8:
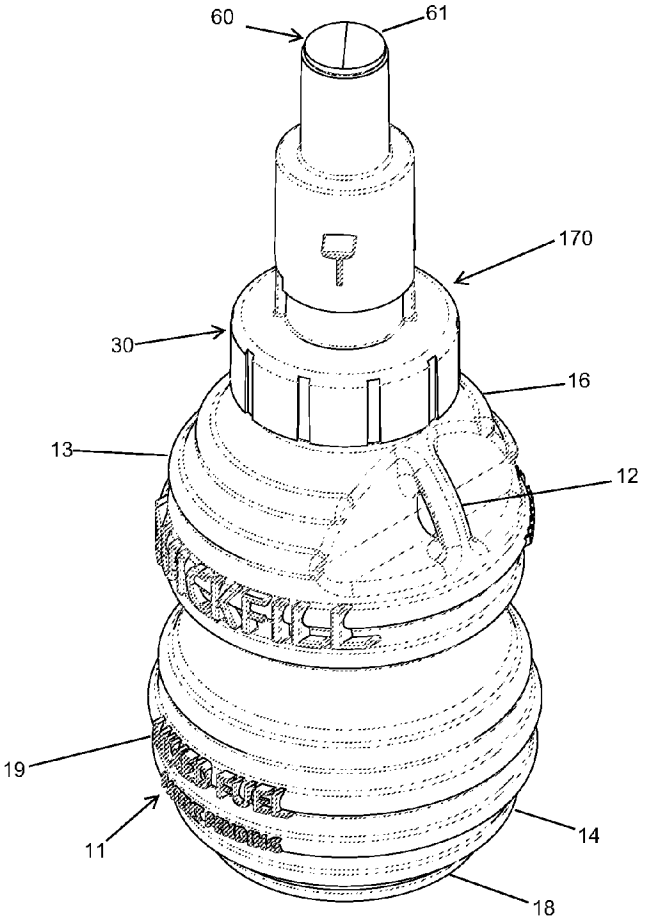
FIG. 8 shows a perspective view of the container system according to an embodiment of the present invention.
Figure 10:
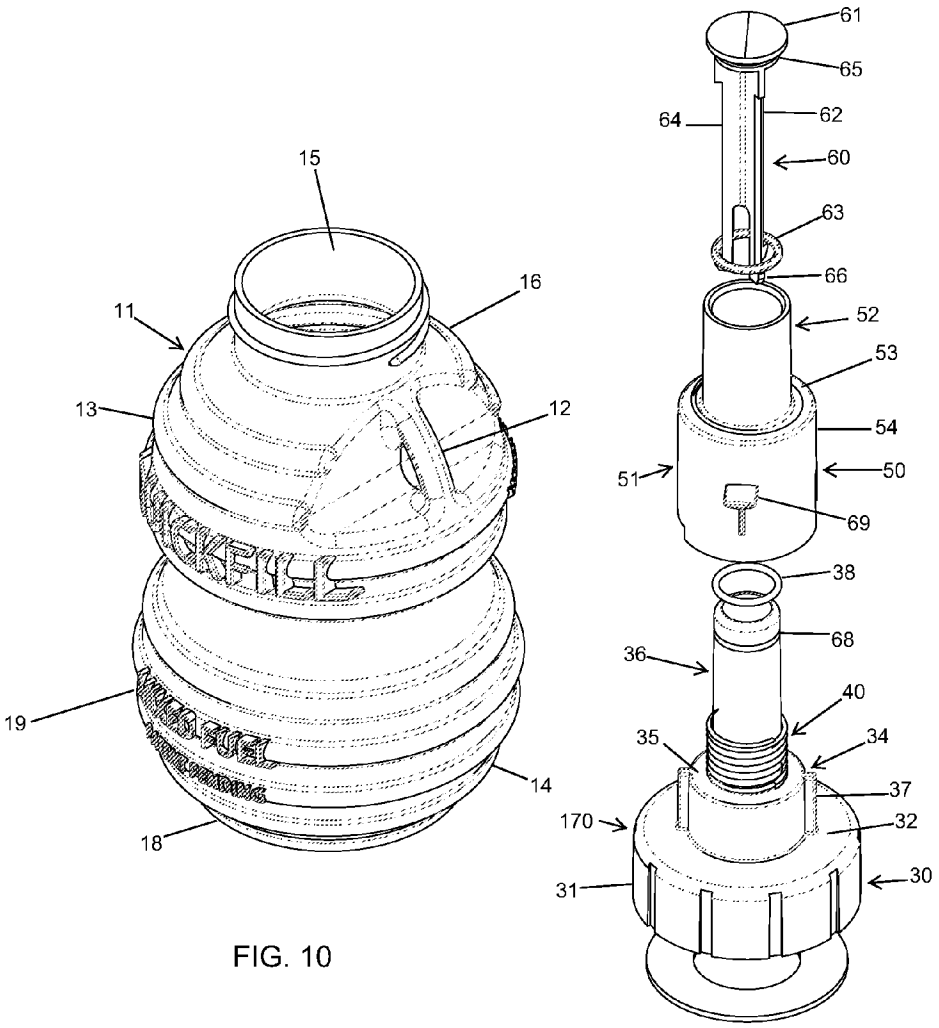
FIG. 10 shows an exploded view of the container system illustrated in FIG. 8.

Referring now to FIG. 1, there is shown an exploded view of the present Invention. The device comprises a portable container 11 for holding a quantity of fuel for an internal combustion engine. The container 11 includes a generally cylindrical container body having an upper end 13, a lower end 14, and sidewalls forming a partially enclosed interior volume for storing gasoline therein. An upper dispensing end 15 includes a shoulder 16 extending upwardly and inwardly towards a pour spout aperture that is adapted to be covered by a removable dispensing cap 17. The dispensing cap 17 is threadably and removably attached over the container aperture for controllably dispensing the contents from the container interior into the fuel tank of an article of lawn equipment. The lower end of the device comprises a container base 18 for supporting the container 11 in an upstanding manner on a horizontal support surface, while a container attachment means 12 is provided along the upper portion of the device or along the removable cap 17 for securing the container to a user's person. The attachment means 12 can be integrated into the container 11 (as illustrated in FIGS. 8-10), or can be integrated into the dispensing cap 17 (as illustrated in FIGS. 1-3).

The container 11 is designed for holding a small quantity of gasoline. In the preferred embodiment, the container 11 has an internal volume for holding between 16 and 32 ounces of gasoline or a similar fluid. The container 11 is constructed from an approved material for storing gasoline, such as polyethylene. Additionally, the container 11 is painted in bright red, and includes indicia 19 printed on the exterior containing the word "gasoline" or with the warning "flammable—keep fire away."

The container 11 and dispensing cap 17 meet both EPA and OSHA regulations for gas cans. In order to meet EPA regulations, the cap 17 and container 11 include a single, self venting opening for filling and pouring with no separate vents or openings. The body is treated for minimal permeation of fuels. The cap 17 utilizes an automatic closure, wherein the nozzle 21 automatically springs to the closed position when not pouring. The nozzle 21 utilizes a conventional spring-loaded plate on the interior and a sleeve 22 on the exterior of the cap 17 that opens the spring-loaded plate when inserted into an opening, and returns to a closed position when removed from the opening. A vent tube 20 within the nozzle 21 enables air to flow into the container 11 to facilitate dispensing. The nozzle 21 additionally includes a child-resistant closure approved by the Children's Gasoline Burn Prevention Act. To meet OSHA regulations, the cap 17 includes a flash arresting screen 23, and a spout cover designed to safely relieve internal pressure when subjected to fire exposure.

Figure 2:
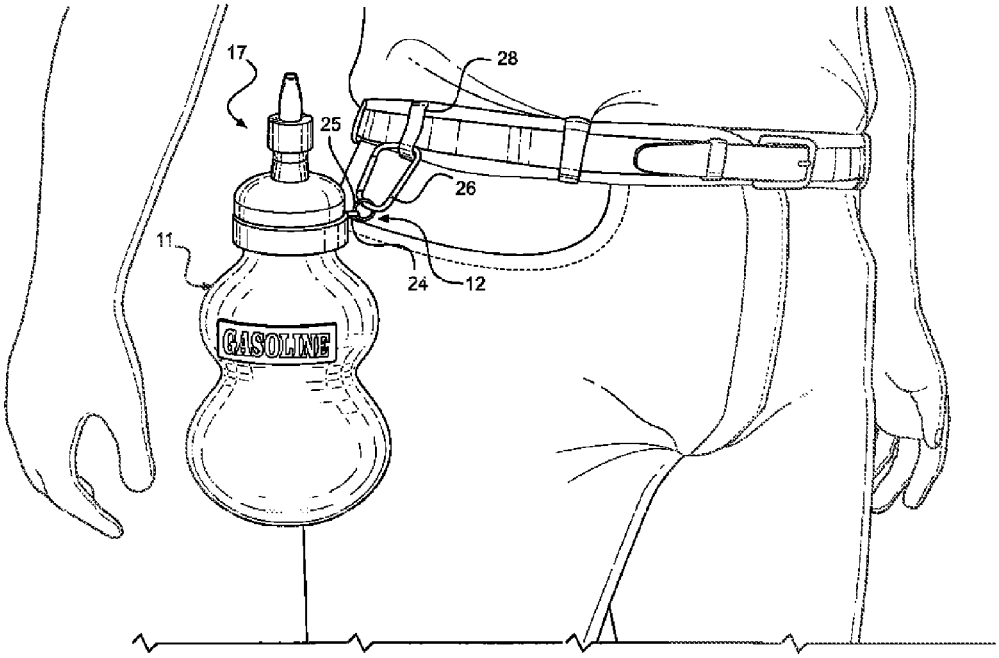
FIG. 2 shows a view of the present invention in a working position, wherein its attachment means is secured to a belt loop of a user's pants.
Figure 3:
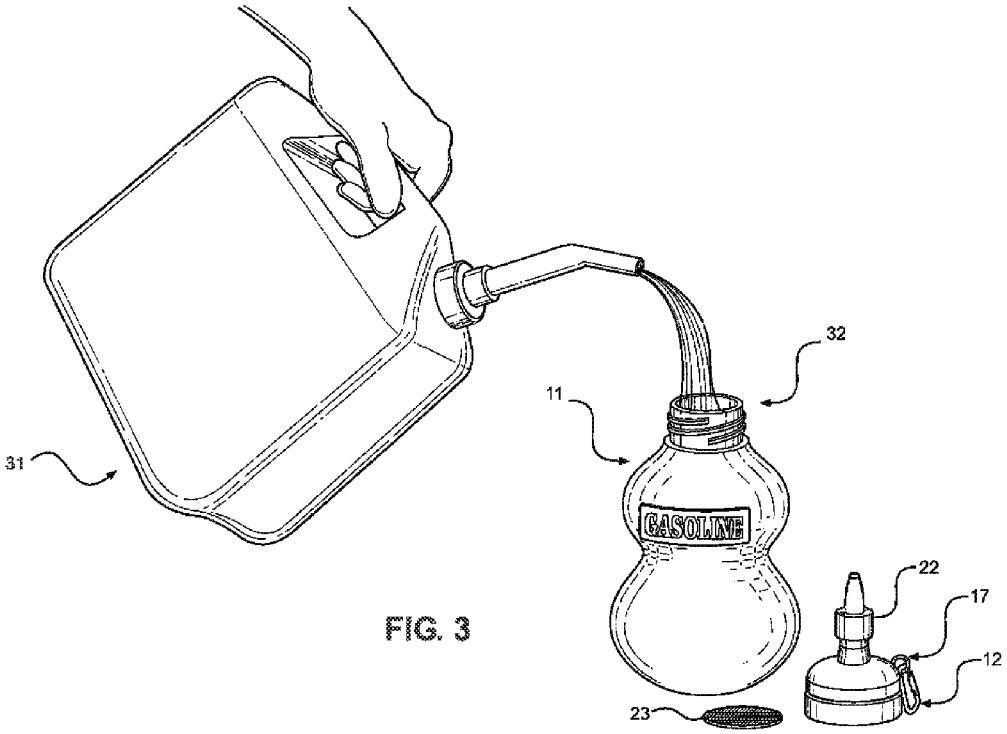
FIG. 3 shows a view of a conventional gas container dispensing fuel into the present invention.

Referring now to FIG. 2, there is shown a view of the attachment means 12 secured to a belt loop 28 on a user. The attachment means 12 enables the container 11 to be secured to a desired location. In a preferred embodiment, the attachment means 12 includes an annular tab 24 extending from the cap 17, an annular ring 25, and a clip 26. As best viewed in FIG. 1, the annular tab includes an aperture 27 in the center for supporting the annular ring 25. The annular tab 24 is integrated into the cap 17, or alternatively, can be integrated into the container 11. When integrated into the cap 17, the attachment means 12 is detached from the container 11 when the cap is removed therefrom. When integrated into the container 11, the cap 17 can be removed from the container while the attachment means 12 remains fixed in position on the container.

Returning now to FIG. 2, the clip 26 may comprise a conventional carabineer, spring loaded clip, or a similar device that can be quickly attached and detached from a support area. As shown, the attachment means 12 enables attachment of the container 11 to a belt loop 28. Attachment to a belt loop 28 or similar support area enables hands free transport of the container 11. A user is free to operate the power equipment or perform other tasks with both hands. When access to the fuel container 11 is desired, the clip 26 can be detached from the belt loop 28 or support area, and the fuel within the container can be dispensed as needed. Once dispensing is complete, the container 11 can be reattached to the belt loop 28.

Referring now to FIG. 3, there is shown a view of a conventional gas can dispensing fuel into the present invention. The container 11 of the present invention is designed to hold a small quantity of fuel for use with an internal combustion engine. The dispensing cap 17 is removed from the container 11, and a conventional gas can 31 is used to transfer fuel into the container. The container 11 includes threads 32 for attaching and detaching the dispensing cap 17. Once fuel is transferred into the container 11, the dispensing cap 17 is threadably attached, and the device can be transported by a user. The container 11 can be carried or attached via the attachment means 12 to a support area, such as a belt loop 28. When the lawn equipment requires refueling, the attachment means 12 is released from the support area, and the dispensing cap 17 is placed within the fuel tank opening. The sleeve 22 is moved to an open position, allowing the springloaded plate to open for dispensing of fuel. Once refueling is complete, the container 11 can be reattached to the support area until the user returns to the fuel source, at which time the container can be refilled with gas.

Figure 4:
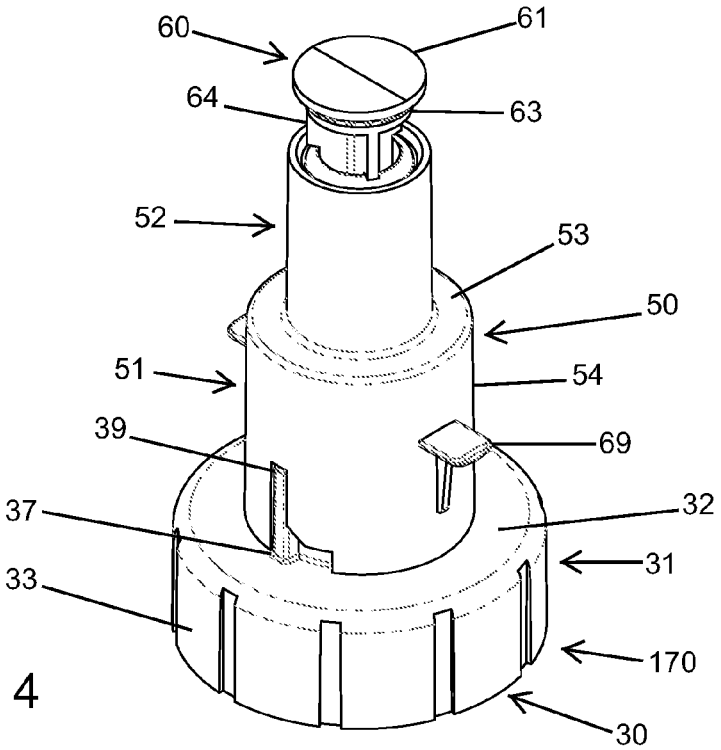
FIG. 4 shows a perspective view of the cap according to an embodiment of the present invention in the open position.
Figure 5:
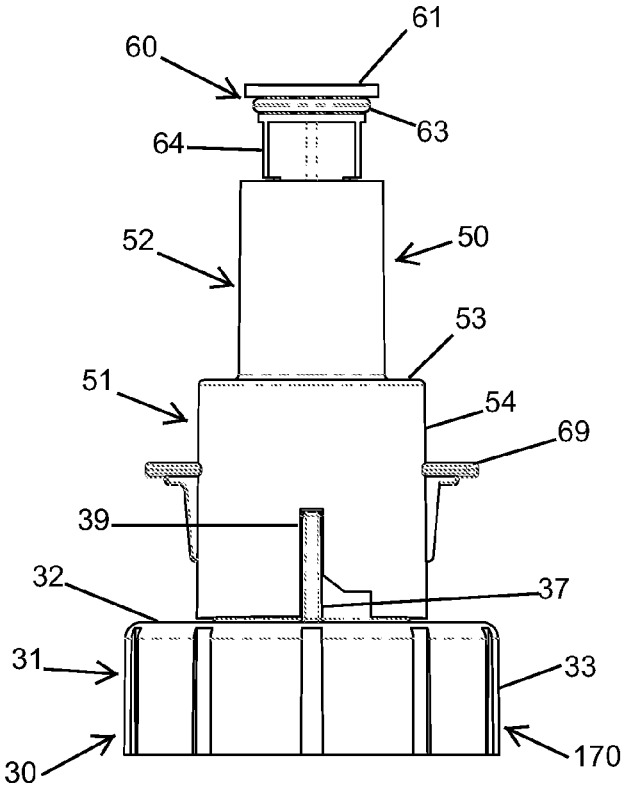
FIG. 5 shows a side view of the cap illustrated in FIG. 4.
Figure 6:
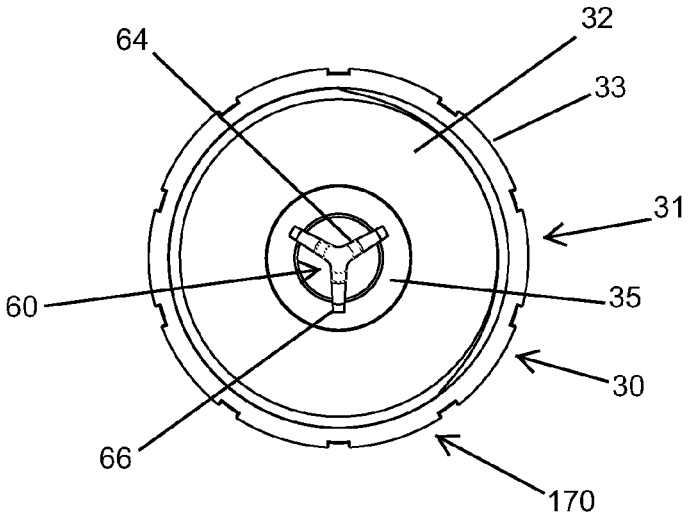
FIG. 6 shows a bottom view of the cap illustrated in FIG. 4.
Figure 7:
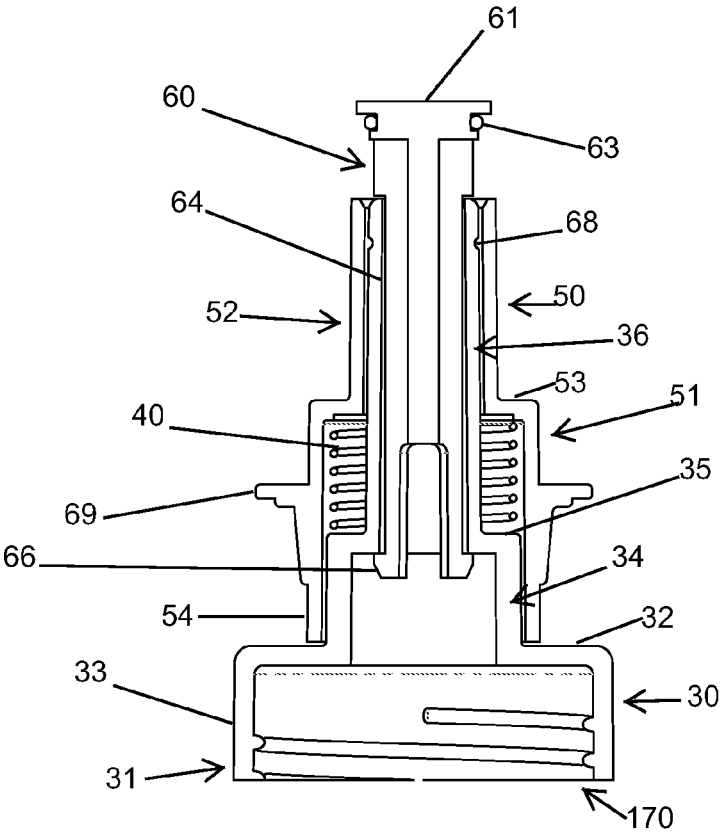
FIG. 7 shows a longitudinal cross sectional view of the cap illustrated in FIG. 4.

Referring now to FIGS. 4-7, details of the dispensing cap 170 are illustrated. As perhaps best illustrated in FIG. 7, the cap 170 according to an embodiment of the present invention includes a first cap member 30, a spring member 40, a second cap member 50 and a plug member 60. The first cap member 30 includes a base 31, an intermediate member 34, a top member 36, and a gasket 38 carried by an upper portion of the top member. As illustrated in FIGS. 4, 5 and 7, the base 31 of the first cap member 30 has a top 32 and sidewalls 33 extending downwardly from the top. The sidewalls 33 of the base 31 include threads on an inner surface thereof. The intermediate member 34 is connected to and extends upwardly from the top 32 of the base 31. The top member 36 is connected to and extends upwardly from a top 35 of the intermediate member 34. As illustrated in FIGS. 4 and 5, at least one tab 37 extends outwardly from and perpendicular to an outer surface of the intermediate member 34 of the first cap member 30. The gasket 38 is within a recess 68 on an exterior surface of the top member 36 of the first cap member 30.

As illustrated in FIG. 7, the spring member 40 is adapted to be carried by the intermediate member 34 of the first cap member 30 and to be positioned adjacent to the top member 36 of the first cap member when carried by the intermediate member. The second cap member 50 movably and detachably connects to the first cap member 30, and overlies the spring member 40 when connected to the first cap member. As illustrated in FIGS. 4, 5 & 7, the second cap member 50 includes a base 51 and a top 52. The base 51 of the second cap member 50 has a top 53 and sidewalls 54 that extend downwardly from the top of the base. The top 52 of the second cap member 50 is connected to and extends upwardly from the base 51. As illustrated in FIGS. 4 and 5, at least one groove 39 is formed in the sidewalls of the base 51 of the second cap member 50 adjacent a bottom portion thereof sized to slidably accept the tab 37 of the intermediate member 34 of the first cap member 30. As illustrated in FIGS. 4, 5 and 7, at least one tab 69 extends outwardly from and perpendicular to an outer surface of the base 51 of the second cap member 50.

As illustrated in FIGS. 4, 5 and 7, the plug member 60 includes a top 61, an elongate bottom 62 extending downwardly therefrom, and a gasket 63 to be carried adjacent to the top. The top 61 of the plug member 60 is adapted to engage the top 52 of the second cap member 50. As illustrated in FIG. 7, the elongate bottom 62 of the plug member 60 extends downwardly through a passageway formed in the second cap member 50 and a passageway formed in the first cap member 30. The passageway formed in the first cap member 30 has a pair of ridges extending from the interior bottom portion of the top 36 of the first cap member 30 to the upper portion of the top member of the first cap member with a recess positioned between the pair of ridges. As illustrated in FIGS. 6 and 7, a bottom portion of the elongate bottom 62 of the plug member 60 is adapted to engage an interior bottom portion of the top 36 of the first cap member 30.

In one embodiment of the cap 17 according to the present invention, the elongate bottom 62 of the plug member 60 includes a plurality of wings 64 descending from an underside of the top 61 of the plug member radiating outwardly from a central point thereof. In another embodiment of the cap according to the present invention three wings 64 descend from the underside of the top 61 of the plug member 60. The plug member 60, according to an embodiment of the present invention, has a gasket 63 within a recess 65 adjacent an underside of the top 61 of the plug member 60. A tab 66 extends outwardly from a distal end of at least one of the three wings 64.

The cap 170 is moveable between an open position and a closed position. As depicted in FIGS. 4, 5 and 7, the open position is defined as the spring member 40 being compressed so that the second cap member 50 slidably moves with respect to the first cap member 30 and so that the top 61 of the plug member 60 is spaced apart from the top 52 of the second cap member.

FIGS. 8-10 illustrate a container system according to an embodiment of the present invention. The container system comprises a container 11 and a cap 170 adapted to be connected to the container. The container 11 comprises a bottom 18 and sidewalls connected to and extending upwardly from a perimeter of the bottom, and an open top connected to the sidewalls. The container 11 includes a generally cylindrical container body having an upper end 13, a lower end 14, and sidewalls forming a partially enclosed interior volume for storing gasoline therein. An upper dispensing end 15 includes a shoulder 16 extending upwardly and inwardly towards a pour spout aperture that is adapted to be covered by a removable dispensing cap 170. The dispensing cap 170 is threadably and removably attached over the container aperture for controllably dispensing the contents from the container interior into the fuel tank of an article of lawn equipment. The lower end of the device comprises a container base 18 for supporting the container 11 in an upstanding manner on a horizontal support surface, while a container attachment means 12 is provided along the upper portion of the device for securing the container to a user's person. The attachment means 12 can be integrated into the container 11.

The cap 170 comprises a first cap member 30, a spring member 40, a second cap member 50 and a plug member 60. The first cap member 30 comprises a base 31, an intermediate member 34, a top member 36, and a gasket 38 carried by an upper portion of the top member. The base 31 of the first cap member 30 has a top 32 and sidewalls 33 extending downwardly from the top. The sidewalls 33 of the base 31 include threads on an inner surface thereof. The intermediate member 34 is connected to and extends upwardly from the top 32 of the base 31. The top member 36 is connected to and extends upwardly from a top 35 of the intermediate member 34. At least one tab 37 extends outwardly from and perpendicular to an outer surface of the intermediate member 34 of the first cap member 30. The gasket 38 is within a recess 68 on an exterior surface of the top member 36 of the first cap member 30.

The spring member 40 is adapted to be carried by the intermediate member 34 of the first cap member 30 and to be positioned adjacent to the top member 36 of the first cap member when carried by the intermediate member. The second cap member 50 movably and detachably connects to the first cap member 30, and overlies the spring member 40 when connected to the first cap member. The second cap member 50 includes a base 51 and a top 52. The base 51 of the second cap member 50 has a top 53 and sidewalls 54 that extend downwardly from the top of the base. The top 52 of the second cap member 50 is connected to and extends upwardly from the base 51. At least one groove 39 is formed in the sidewalls of the base 51 of the second cap member 50 adjacent a bottom portion thereof sized to slidably accept the tab 37 of the intermediate member 34 of the first cap member 30. At least one tab 69 extends outwardly from and perpendicular to an outer surface of the base 51 of the second cap member 50.

The plug member 60 comprises a top 61, an elongate bottom 62 extending downwardly therefrom, and a gasket 63 to be carried adjacent to the top. The top 61 of the plug member 60 is adapted to engage the top 52 of the second cap member 50. The elongate bottom 62 of the plug member 60 extends downwardly through a passageway formed in the second cap member 50 and a passageway formed in the first cap member 30. The passageway formed in the first cap member 30 has a pair of ridges extending from the interior bottom portion of the top 36 of the first cap member 30 to the upper portion of the top member of the first cap member with a recess positioned between the pair of ridges. A bottom portion of the elongate bottom 62 of the plug member 60 is adapted to engage an interior bottom portion of the top 36 of the first cap member 30.

As perhaps best illustrated in FIG. 10, in one embodiment of the container system according to the present invention, the elongate bottom 62 of the plug member 60 includes a plurality of wings 64 descending from an underside of the top 61 of the plug member radiating outwardly from a central point thereof. In another embodiment of the cap according to the present invention three wings 64 descend from the underside of the top 61 of the plug member 60. The plug member 60, according to an embodiment of the present invention, has a gasket 63 within a recess 65 adjacent an underside of the top 61 of the plug member 60. A tab 66 extends outwardly from a distal end of at least one of the three wings 64.

As illustrated in FIGS. 8 and 9, the cap 170 is moveable between an open position and a closed position. The open position is defined as the spring member 40 being compressed so that the second cap member 50 slidably moves with respect to the first cap member 30 and so that the top 61 of the plug member 60 is spaced apart from the top 52 of the second cap member.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

That which is claimed is:

1. A cap adapted to be connected to a container, the cap comprising:

a first cap member comprising a base having a top and sidewalls extending downwardly from the top, an intermediate member connected to and extending upwardly from the top of the base, a top member connected to and extending upwardly from a top of the intermediate member, and a gasket carried by an upper portion of the top member;

a spring member adapted to be carried by the intermediate member of the first cap member and to be positioned adjacent to the top member of the first cap member when carried by the intermediate member;

a second cap member that movably and detachably connects to the first cap member, and that overlies the spring member when connected to the first cap member, the second cap member comprising a base having a top and sidewalls that extend downwardly from the top, and a top connected to and extending upwardly from the base; and a plug member comprising a top, an elongate bottom extending downwardly therefrom including a three wings descending from an underside of the top of the plug member radiating outwardly from a central point thereof, and a gasket to be carried adjacent to the top of the plug member;

wherein the top of the plug member is adapted to engage the top of the top of the second cap member;

wherein the elongate bottom of the plug member extends downwardly through a passageway formed in the second cap member and a passageway formed in the first cap member;

wherein a bottom portion of the elongate bottom of the plug member is adapted to engage an interior bottom portion of the top of the first cap member; and wherein the cap is moveable between an open position and a closed position, the open position being defined as the spring member being compressed so that the second cap member slidably moves with respect to the first cap member and so that the top of the plug member is spaced apart from the top of the second cap member.

2. The cap of claim 1, wherein at least one tab extends outwardly from and perpendicular to an outer surface of the intermediate member of the first cap member and at least one groove is formed in the sidewalls of the base of the second cap member adjacent a bottom portion thereof sized to slidably accept the tab of the intermediate member of the first cap member.

3. The cap of claim 1, wherein the gasket of the first cap member is within a recess on an exterior surface of the top member.

4. The cap of claim 1, wherein the gasket of the plug member is positioned within a recess adjacent an underside of the top of the plug member.

5. The cap of claim 1, wherein a tab extends outwardly from a distal end of at least one of the three wings.

6. The cap of claim 1, wherein the sidewalls of the base include threads on an inner surface thereof.

7. The cap of claim 1, wherein at least one tab extends outwardly from and perpendicular to an outer surface of the base of the second cap member.

8. A cap adapted to be connected to a container, the cap comprising:

a first cap member comprising a base having a top and sidewalls extending downwardly from the top, an intermediate member connected to and extending upwardly from the top of the base, a top member connected to and extending upwardly from a top of the intermediate member, and a gasket carried within a recess on an exterior surface of an upper portion of the top member;

a spring member adapted to be carried by the intermediate member of the first cap member and to be positioned adjacent to the top member of the first cap member when carried by the intermediate member;

a second cap member that movably and detachably connects to the first cap member, and that overlies the spring member when connected to the first cap member, the second cap member comprising a base having a top and sidewalls that extend downwardly from the top, and a top connected to and extending upwardly from the base; and a plug member comprising a top, an elongate bottom extending downwardly therefrom, and a gasket carried within a recess adjacent an underside of the top;

wherein the sidewalls of the base include threads on an inner surface thereof;

wherein at least one tab extends outwardly from and perpendicular to an outer surface of the intermediate member of the first cap member and at least one groove is formed in the sidewalls of the base of the second cap member adjacent a bottom portion thereof sized to slidably accept the tab of the intermediate member of the first cap member;

wherein a tab extends outwardly from a distal end of at least one of the three wings;

wherein the top of the plug member is adapted to engage the top of the top of the second cap member;

wherein the elongate bottom of the plug member extends downwardly through a passageway formed in the second cap member and a passageway formed in the first cap member;

wherein the elongate bottom of the plug member includes three wings descending from an underside of the top of the plug member radiating outwardly from a central point thereof;

wherein a bottom portion of the elongate bottom of the plug member is adapted to engage an interior bottom portion of the top of the first cap member;

wherein the cap is moveable between an open position and a closed position, the open position being defined as the spring member being compressed so that the second cap member slidably moves with respect to the first cap member and so that the top of the plug member is spaced apart from the top of the second cap member; and wherein at least one tab extends outwardly from and perpendicular to an outer surface of the base of the second cap member.

9. A container system comprising:

a container comprising a bottom and sidewalls connected to and extending upwardly from a perimeter of the bottom, and an open top connected to the sidewalls; and a cap adapted to be connected to the container, the cap comprising a first cap member comprising a base having a top and sidewalls extending downwardly from the top, an intermediate member connected to and extending upwardly from the top of the base, a top member connected to and extending upwardly from a top of the intermediate member, a gasket carried by an upper portion of the top member, a spring member adapted to be carried by the intermediate member of the first cap member and to be positioned adjacent to the top member of the first cap member when carried by the intermediate member, a second cap member that movably and detachably connects to the first cap member, and that overlies the spring member when connected to the first cap member, the second cap member comprising a base having a top and sidewalls that extend downwardly from the top, and a top connected to and extending upwardly from the base, a plug member comprising a top, an elongate bottom extending downwardly therefrom, a gasket to be carried adjacent to the top;

wherein the sidewalls of the base include threads on an inner surface thereof and wherein the top of the container has threads on an exterior surface thereof adapted to matingly engage the threads on the inner surface of the sidewalls of the base, wherein the top of the plug member is adapted to engage the top of the top of the second cap member, wherein the elongate bottom of the plug member extends downwardly through a passageway formed in the second cap member and a passageway formed in the first cap member, wherein the elongate bottom of the plug member includes a three wings descending from an underside of the top of the plug member radiating outwardly from a central point thereof, wherein a bottom portion of the elongate bottom of the plug member is adapted to engage an interior bottom portion of the top of the first cap member, and wherein the cap is moveable between an open position and a closed position, the open position being defined as the spring member being compressed so that the second cap member slidably moves with respect to the first cap member and so that the top of the plug member is spaced apart from the top of the second cap member.

10. The system of claim 9, wherein at least one tab extends outwardly from and perpendicular to an outer surface of the intermediate member of the first cap member and at least one groove is formed in the sidewalls of the base of the second cap member adjacent a bottom portion thereof sized to slidably accept the tab of the intermediate member of the first cap member.

11. The system of claim 9, wherein the gasket is within a recess on an exterior surface of the top member.

12. The system of claim 9, wherein the plug member has a gasket within a recess adjacent an underside of the top of the plug member.

13. The system of claim 9, wherein a tab extends outwardly from a distal end of at least one of the three wings.

14. The system of claim 9, wherein at least one tab extends outwardly from and perpendicular to an outer surface of the base of the second cap member.

* * * * *